US007195500B2

(12) United States Patent
Huang et al.

(10) Patent No.: US 7,195,500 B2
(45) Date of Patent: Mar. 27, 2007

(54) GROUND FAULT CIRCUIT INTERRUPTER WITH END OF LIFE INDICATORS

(76) Inventors: Huadao Huang, c/o Shanghai Meihao Electric Inc., No. 58, Shahe Road, Jiangqiao Town, Jiading Borough, Shanghai (CN) 201803; Huayang Lu, c/o Shanghai Meihao Electric Inc., No. 58, Shahe Road, Jiangqiao Town, Jiading Borough, Shanghai (CN) 201803

( * ) Notice: Subject to any disclaimer, the term of this patent is extended or adjusted under 35 U.S.C. 154(b) by 0 days.

(21) Appl. No.: 11/362,037

(22) Filed: Feb. 27, 2006

(65) Prior Publication Data

US 2006/0193092 A1 Aug. 31, 2006

Related U.S. Application Data

(60) Provisional application No. 60/656,090, filed on Feb. 25, 2005.

(51) Int. Cl.
*H01R 13/648* (2006.01)

(52) U.S. Cl. ..... 439/107; 439/535; 335/18; 361/42

(58) Field of Classification Search ..... 439/107, 439/535; 335/18; 361/42, 44
See application file for complete search history.

(56) References Cited

U.S. PATENT DOCUMENTS 3,864,649 A * 2/1975 Doyle ..... 335/21
4,386,338 A 5/1983 Doyle et al.
4,518,945 A 5/1985 Doyle et al.
4,595,894 A 6/1986 Doyle et al.
5,202,662 A 4/1993 Bienwald et al.
5,654,857 A 8/1997 Gershen
5,680,287 A 10/1997 Gernhardt et al.
5,963,408 A 10/1999 Neiger et al.
6,040,967 A 3/2000 DiSalvo
6,052,265 A 4/2000 Zaretsky et al.
6,111,733 A 8/2000 Neiger et al.
6,226,161 B1 5/2001 Neiger et al.
6,246,558 B1 6/2001 DiSalvo et al.
6,252,407 B1 6/2001 Gershen
6,282,070 B1 8/2001 Ziegler et al.
6,288,882 B1 9/2001 DiSalvo et al.
6,309,248 B1 10/2001 King
6,381,112 B1 4/2002 DiSalvo
6,437,953 B2 8/2002 DiSalvo et al.
6,469,881 B2 10/2002 Gershen et al.
6,580,344 B2 6/2003 Li
6,671,145 B2 12/2003 Germain et al.
6,693,779 B2 * 2/2004 DiSalvo ..... 361/42
6,864,766 B2 3/2005 DiSalvo et al.
6,930,574 B2 * 8/2005 Gao ..... 335/18

(Continued)

*Primary Examiner*—Michael C. Zarroli
(74) *Attorney, Agent, or Firm*—Fei-Fei Chao; Andrews Kurth LLP

(57) ABSTRACT

The present invention provides a GFCI that not only has ground fault protection, but also is capable of providing reverse wiring protection as well as detection of end of the service life of the GFCI by way of utilizing an end of life detection control circuit in connection with the reset button. In addition, the GFCI of the present invention provides a forcible mechanical tripping assembly by way of utilizing the test button. Finally, the present invention provides method for detecting whether the service life of the GFCI has ended.

19 Claims, 7 Drawing Sheets

U.S. PATENT DOCUMENTS 6,954,125 B2 * 10/2005 Wu et al. ..... 335/18
6,958,895 B1 * 10/2005 Radosavljevic et al. ..... 361/42
6,963,260 B2 11/2005 Germain et al.
6,998,945 B2 * 2/2006 Huang et al. ..... 335/18
7,019,952 B2 3/2006 Huang et al.
7,031,125 B2 * 4/2006 Germain et al. ..... 361/42
7,049,910 B2 5/2006 Campolo et al.
7,049,911 B2 5/2006 Germain et al.

* cited by examiner

GROUND FAULT CIRCUIT INTERRUPTER WITH END OF LIFE INDICATORS

RELATED APPLICATION

The present application claims the priority of U.S. Provisional Patent Application Ser. No. 60/656,090, filed on Feb. 25, 2005, which is herein incorporated by reference.

FIELD OF THE INVENTION

The present invention relates to a circuit interrupting device, such as a ground fault circuit interrupter ("GFCI"), which possesses end of life test capability by way of utilizing an end of life detection control circuit in conjunction with the reset button. The present invention further relates to a forcible mechanical trip assembly by way of using the test button. Finally, the present invention relates to methods for detecting end of life of the circuit interrupting device.

BACKGROUND OF THE INVENTION

GFCIs, such as ground fault circuit interrupters ("GFCIs"), have been widely used by consumers since 1970s. Nowadays, due to household safety concerns, there are needs for GFCIs with extra safety features. According to new UL standards under 934A which are going to be in effective starting in June 2006, a GFCI will be required not only to have reverse wiring protection, but also to be able to provide a user with indications to alert the user when the GFCI has reached the end of its service life and is no longer capable of providing ground fault protection. That is because for most of the GFCIs currently available on the market, when their service life ends, resetting by pressing the reset button is still possible, which gives the users a false sense of security that they are still under proper protection of the GFCI, while in fact the GFCIs' capability of sensing a ground fault and cutting off the electricity due to a ground fault has been compromised. Thus, when a ground fault occurs, the GFCI is unable to provide any protection, which can result in fatal electric shocks.

In the invention to be presented in the following sections, a newly-designed GFCI which is capable of performing an end of life test is provided. The GFCI of the present invention allows the user to detect whether the service life of the device has ended by simply pressing the reset button, if the GFCI can be reset, the GFCI shows continuing capability of detecting a ground fault. If the GFCI cannot be reset, it means that the end of the service life of the GFCI has been reached, and the user should consider replacing the GFCI.

SUMMARY OF THE INVENTION

The circuit interrupting device of the present invention contains a line side connection capable of being electrically connected to a source of electricity; a load side connection capable of being electrically connected to a load side conductor; and a user accessible load. The circuit interrupting device is characterized by having a trip assembly which can be activated by a ground fault or a simulated fault, and a circuit board, which contains 2 pairs of flexible metal pieces, each having a movable contact point.

The first pair of the flexible metal pieces is operationally connected to power source input terminals. One end of each of the first pair of the flexible metal pieces passes through a differential transformer and is operationally connected to a hot input line or a neutral input line. The other end of each of the first pair of the flexible metal pieces has a movable contact point, which is capable of electrically connecting/disconnecting to a fixed contact point of a first output conductor. One end of each of the second pair of flexible metal pieces is operationally connected to a hot power output terminal or a neutral power output terminal. The other end of each of the second pair of the flexible metal pieces has a movable contact point, which is capable of electrically connecting/disconnecting to a fixed contact point of a second output conductor. Both the first and the second output conductors are positioned in the center portion of the housing near an intermediate support. Each of the first and the second output conductors contains a pair of fixed contact points.

The housing has a front lid, which comprises two output socket holes, which can be connected to household appliances; a reset button; and a test button.

The housing also has a base. Both the circuit board and the trip assembly are positioned in the base.

The trip assembly comprises a tripping device, a locking member, a locking spring, a tripping lever, and a solenoid coil.

The tripping device is shaped like a cylinder and is positioned below the reset button. It has a central aperture which can receive a directional lock which is coupled to the reset button. The directional lock has a blunt end and a locking groove, which allows the directional lock to lock in to the tripping device. The directional lock is movable in a vertical direction in the aperture of the tripping device.

The locking member is L-shaped and is formed from a metal material. It is connected to the lower part and penetrates through the tripping device. The locking member contains a horizontal side extending into the tripping device and through the aperture and a vertical side having an inner surface and an outer surface. The horizontal side of the locking member has an opening therein and is movable through the aperture in a horizontal direction between an aligned position in which the opening of the locking member is aligned with the blunt end of the directional lock and a misaligned position in which the opening is misaligned with the blunt end of the directional lock.

The locking spring is located between a side wall of the tripping device and the inner surface of the vertical side of the L-shaped locking member. When the tripping device and the locking member are in the aligned position, the locking spring is compressed. When the tripping device and the locking member are in the misaligned position, the locking spring is relaxed.

The solenoid coil is positioned at the outer surface of the L-shaped locking member. The solenoid coil has a movable plunger in the center. When the solenoid coil is energized, the plunger moves horizontally towards the outer surface of the vertical side of the locking member, thereby moving the locking member into the aligned position.

The tripping lever is connected to a hole at the horizontal side of the L-shaped locking member.

The tripping device, the locking member, the locking spring, and the tripping lever are connected to each other to form an integral body that can move freely.

In addition, the tripping device comprises a pair of lifting arms. The movable contact points of the first and second pairs of flexible metal pieces on the circuit board are positioned above the pair of the lifting arms.

Also, the movable contact points of the first pair of the flexible metal pieces are in a different cross sectional plane from the second pair of the flexible metal pieces.

Furthermore, the bottom portion of the tripping device is operationally connected to the circuit board through a power source switch containing a movable contact located at the bottom of the tripping device and a fixed contact located at the circuit board; whereby when the reset button is depressed, the movable contact is in contact with the fixed contact so as to close the power source switch and when the reset button is released, the movable contact is detached from the fixed contact so as to open the power source switch.

The circuit interrupting device further comprises an end of life test mechanism which comprises an end of life detection control integrated circuit ("IC2"). The IC2 starts to operate when the power source switch is closed.

The close of the power source switch provides the IC2 with power, which enables the IC2 to generate a simulated fault so as to test the functions of the circuit interrupting device. When the circuit interrupting device functions properly, the depression and release of the reset button reestablish the electrical continuity and when the circuit interrupting device fails to detect the simulated fault, the depression and release of the reset button prevent the establishment of the electrical continuity. A preferred example of IC2 is an IC20060215.

The IC2 is further connected to a leakage current detection control integrated circuit ("IC1"). A preferred example of IC1 is an RV4145.

The IC1 is connected to the differential transformer. When a ground fault or a simulated fault (from IC2) is detected, the differential transformer sends a signal to the IC1, which in turn sends a signal to a silicon control rectifier (SCR1) to trigger the reaction of the trip assembly to interrupt the electrical continuity.

The center portion of the housing contains an intermediate support. An indicator light, such as a green light, which can be displayed at the front lid, is positioned in the intermediate support. The terminals of the indicator light are connected to the hot and white (i.e., the neutral) output lines. When the service life of the device has ended, the indicator light is lighted.

Each of the pair of the output conductors at the intermediate support comprises a pair of gripping wing pieces. The first pair of gripping wing pieces protrudes to the hot wire sides of the output socket holes at the front lid. The second pair of the gripping wing pieces protrudes to the white wire side of the output socket holes at the front lid.

The circuit interrupting device contains a test button at the front lid. The test button has a tail end which is extended to the end of the "7" shaped tripping lever. When the test button is depressed, the tail end of the test button presses against the tripping lever and forcibly causes the device to trip.

The circuit interrupting device further comprises a position limiting piece below each of the flexible metal pieces.

The circuit interrupting device possesses reverse wire protection capability. When the input wires and output wires are reversely installed, the close of the power source switch by depressing the reset button generates no power to allow the IC2 to generate a simulated fault. As a result, the depression and release of the reset button cannot reset the device.

Finally, the present invention provides a method to detect whether the service life of the GFCI ends by requiring the user to depress and then release the reset button, and to observe whether the circuit interrupting device has been reset. Alternatively, the user can detect whether the service life of the GFCI ends by depressing and releasing the reset button and monitoring whether the indicator light is lighted or not.

BRIEF DESCRIPTION OF THE FIGURES

FIG. 5-1 is a partial cross section along C—C in FIG. 3, illustrating the starting state of the GFCI after it is reset.

FIG. 5-2 is a partial cross section along C—C in FIG. 3, illustrating the normal working state of the GFCI.

FIG. 5-3 is a partial cross section along C—C in FIG. 3, illustrating the state when the GFCI trips when the test button is pressed.

FIG. 5-4 is a partial cross section along C—C in FIG. 3, illustrating the state when the outlet is forcibly tripped by pressing the test button.

DETAILED DESCRIPTION OF THE INVENTION

The present invention not only has a ground fault protection function but also can check whether the GFCI still has the ground fault protection function and whether its service life has ended by pressing the reset button after the GFCI of the present invention is connected to the hot and neutral (i.e., white) wires of the power source inside the wall. For example, when the service life of the GFCI has ended, the GFCI of the present invention allows no power output to the load side output terminal and to the three-prong output sockets of the face of the GFCI to avoid fatal accidents caused by electric shocks by requiring the user to press and release the reset button of the GFCI. In addition, if certain parts in the GFCI become defective, such as the differential transformers, the ICs, the solenoid coil, and the silicon controlled rectifier (SCR), the GFCI of the present invention provides a mechanism which can forcibly and mechanically trigger the trip assembly so as to interrupt the power output to the outlet by depressing the test button. The present invention thus guarantees the safety of the user and the safety use of the electrical appliances.

Figure 1:
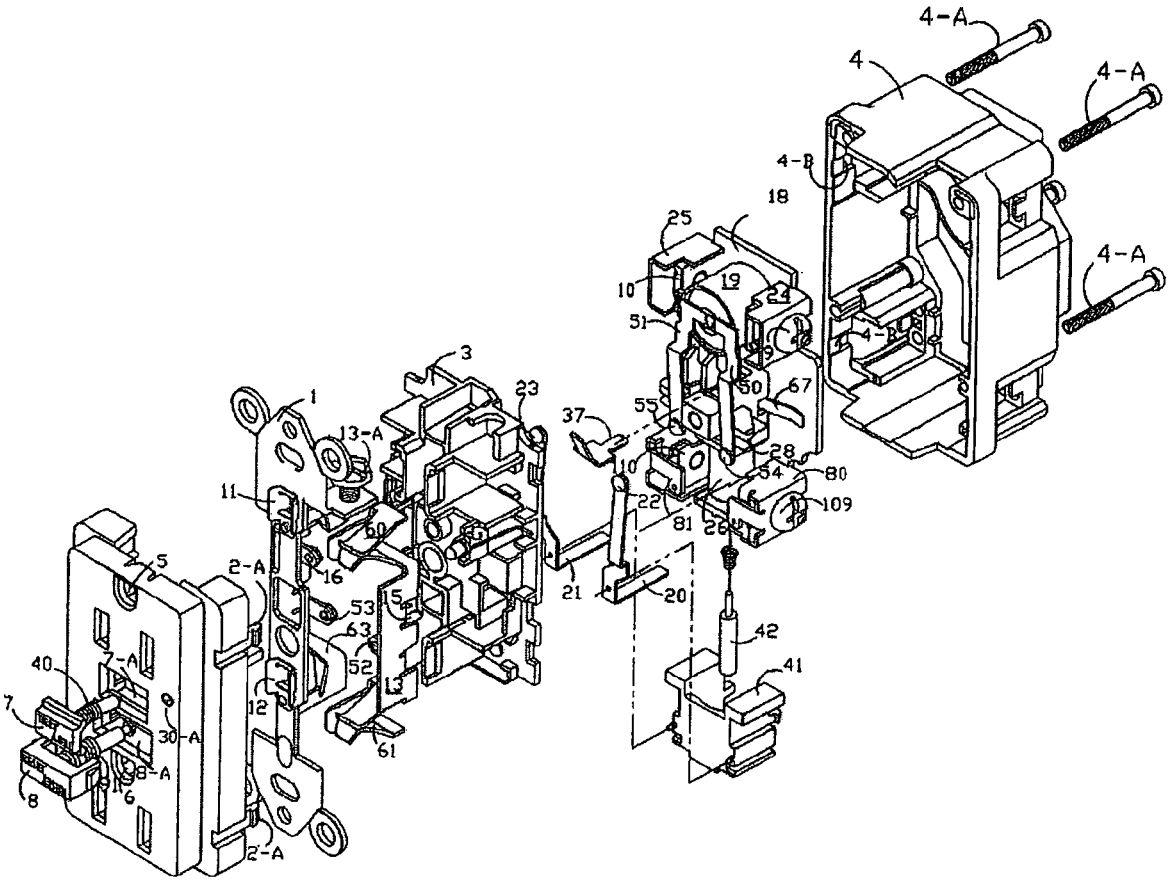
FIG. 1 is a cut-away oblique view illustrating the structure of the present invention.
Figure 2:
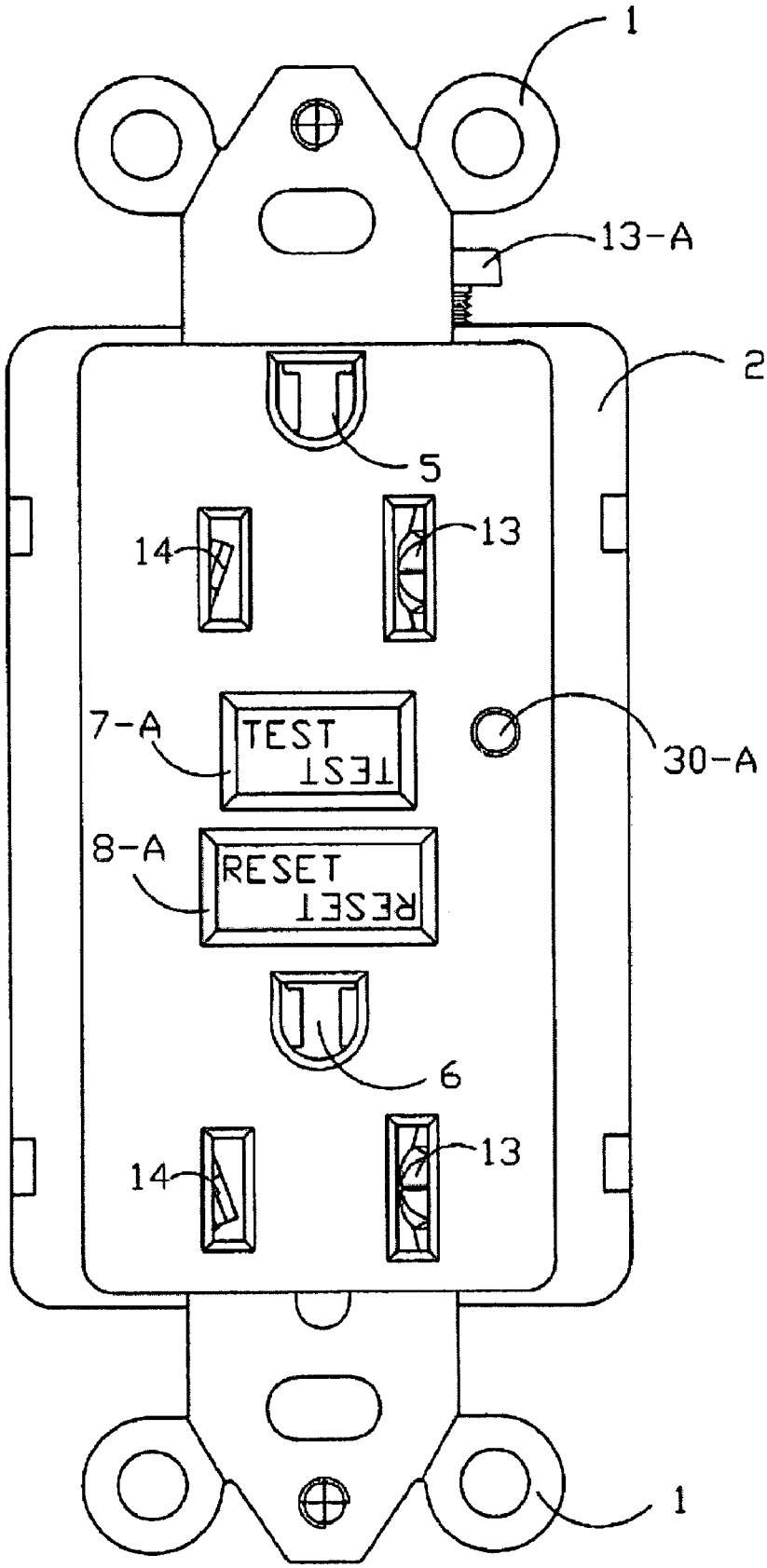
FIG. 2 is a front view of the present invention.

As shown in FIGS. 1 and 2, the GFCI of the present invention comprises a housing. The housing further comprises a front lid 2, an intermediate support 3, and a base 4. A circuit board 18 is installed in the base of the housing. The circuit board serves to control power output from the power source and detects the end of the service life of the GFCI in connection with the depression of the reset button to turn on the power source switch (K3) and then the end of life detection control integrated circuit (IC2).

A metal mounting strap 1 is installed between front lid 2 and intermediate support 3. Circuit board 18 is installed between intermediate support 3 and base 4.

Power output sockets holes 5, 6, reset button hole 8-A, test button hole 7-A, and indicator light hole 30-A are formed on front lid 2. Reset button (RESET) 8 and test button (TEST) 7 are installed in reset button hole 8-A and test button hole 7-A, respectively. Reset button 8 and test button 7 penetrate through mounting strap 1 and intermediate support 3 to contact various parts on circuit board 18. Four hooks 2-A are arranged on the side of front lid 2 to hook in slots 4-B on base 4.

Mounting strap 1 is grounded through grounding screw 13-A (as shown in FIGS. 1–2) and wires. Grounding elements 11, 12 are arranged on mounting strap 1 at locations corresponding to the grounding holes of power output sockets 5, 6 of front lid 2.

Figure 3:
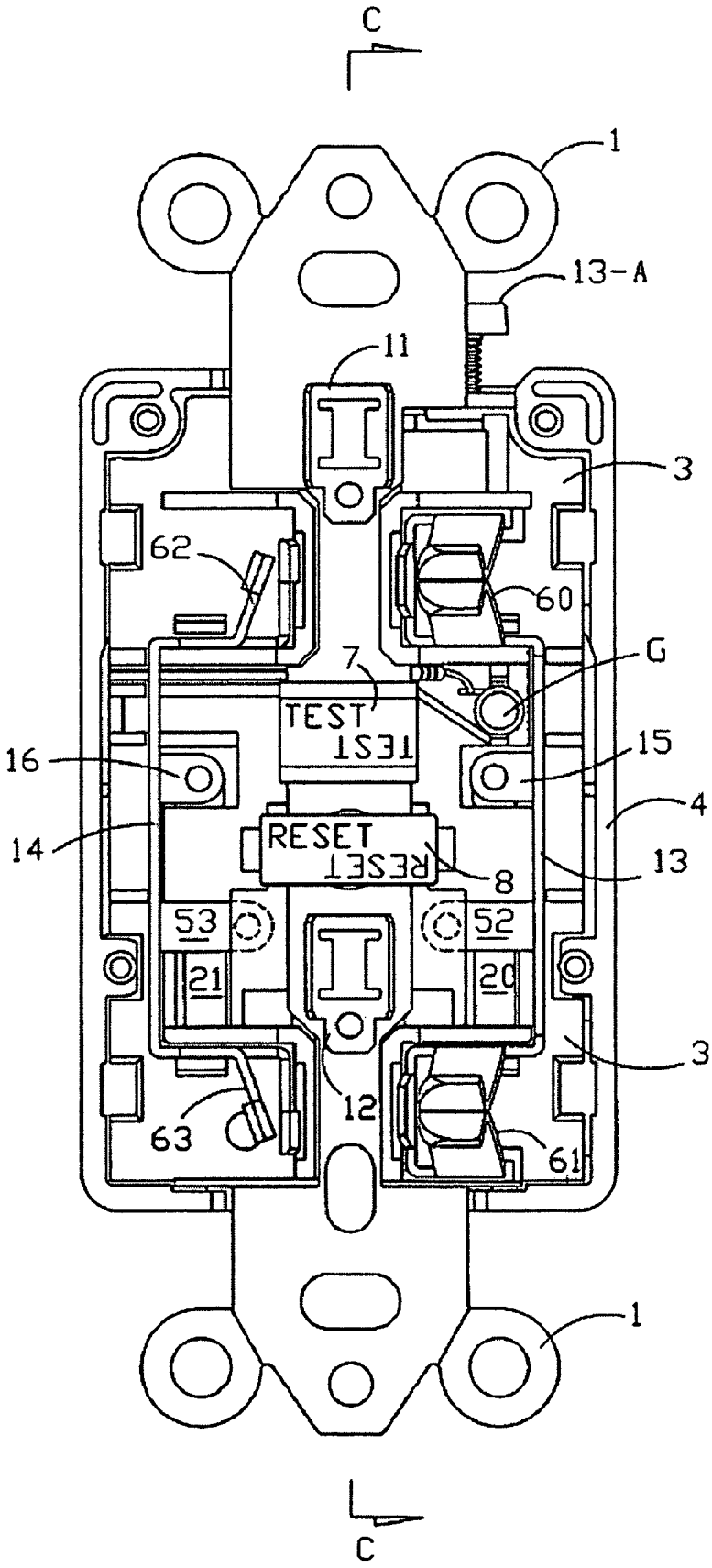
FIG. 3 is a front view of the present invention after the front lid is removed.

As shown in FIGS. 1 and 3, a hot (phase) power output conductor 14 and a white (neutral) power output conductor 13 are installed on the two sides of intermediate support 3. At the two ends of power output conductors 13, 14, gripping wing pieces 60, 61, 62, 63 are arranged at locations corresponding to the hot and white wire holes of power output sockets 5, 6 on the front lid 2. Fixed contact points 15, 52 (i.e., first and second fixed contact points) and 16, 53 (i.e., third and fourth fixed contact points) are also located at power output conductors 13, 14 to form two pairs of fixed contact points 15, 16 and 52, 53.

A green indicator light G is also soldered on intermediate support 3. The indicator light G protrudes to indicator light hole 30-A on front lid 2. The two terminals of the indicator light G are connected to the hot and white wires at the power output terminal (load output terminal) of the GFCI. The light is used to indicate the working status of the GFCI.

As shown in FIG. 1, base 4 is used to accommodate intermediate support 3 and circuit board 18. A pair of hot and white power input wiring screws 9, 10, and a pair of hot and white power output wiring screws 109, 110 are installed symmetrically on the two sides of base 4.

A key part of the present invention is the circuit board 18 which is installed in base 4 of the housing. It can supply power to or cut power from the power output sockets holes 5, 6 of front lid 2 and the power output wiring screws 109, 110 on the two sides of base seat 4 and can automatically detect whether the service life of the GFCI has ended.

Figure 4:
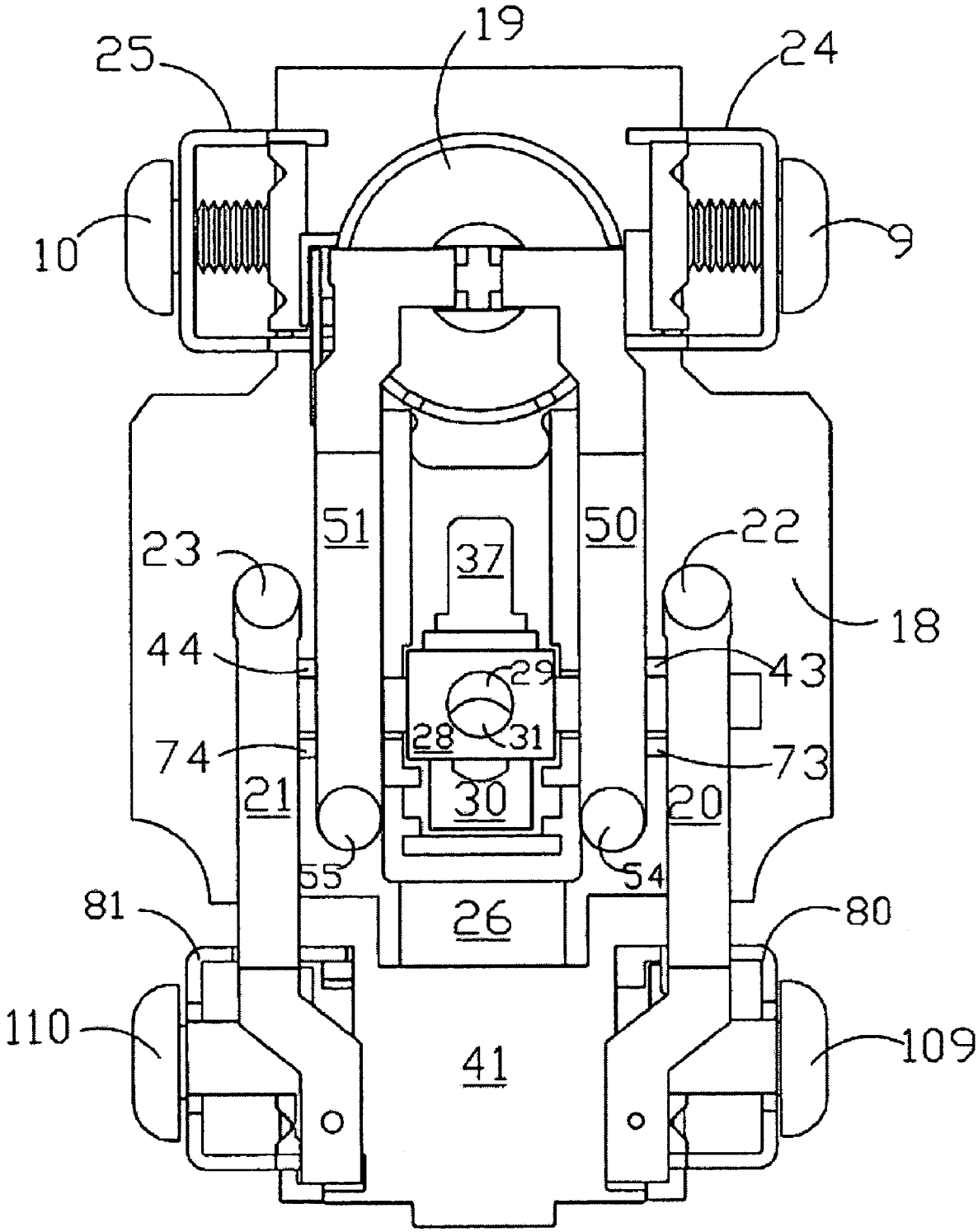
FIG. 4 is a diagram illustrating the positional relationship of each part on the circuit board in the present invention.

As shown in FIGS. 1 and 4, two flexible power input metal pieces 50, 51 are arranged on circuit board 18. One end of each of the flexible power input metal pieces 50, 51 is bent downward by 90°, passes through differential transformer 19, is soldered on circuit board 18 and is connected to hot and white power input wiring screws 9, 10 via input wiring pieces 24, 25. White (neutral) power input wiring screw 9 is connected to the white (neutral) wire of the power source inside the wall via a conductive wire. Hot power input wiring screw 10 is connected to the hot wire of the power source inside the wall via a conductive wire. Movable contact points 54, 55 are arranged at the other end of flexible power input metal pieces 50, 51. The movable contact points 54, 55 correspond to the fixed contact points 52, 53 (as shown in FIG. 3) on the power output conductors 13, 14, respectively, on intermediate support 3. Two flexible metal output pieces 20, 21 are arranged on two sides above circuit board 18. One end of the flexible metal pieces 20, 21 is soldered to white wire and hot wire output terminals 80, 81, respectively, on circuit board 18 and is connected to the power output wiring screws 109, 110 on the two sides of base 4. Movable contact points 22, 23 are arranged at the other end of the flexible metal pieces 20, 21. The movable contact points 22, 23 correspond to the fixed contact points 15, 16 on power output conductors 13, 14 (as shown in FIG. 3). The movable contact points and fixed contact points on the flexible power input metal pieces 50, 51, power output conductors 13, 14, and flexible metal pieces 20, 21 form two groups of four pairs of on/off switches 54 and 52, 55 and 53, 22 and 15, and 23 and 16.

Figure 6:
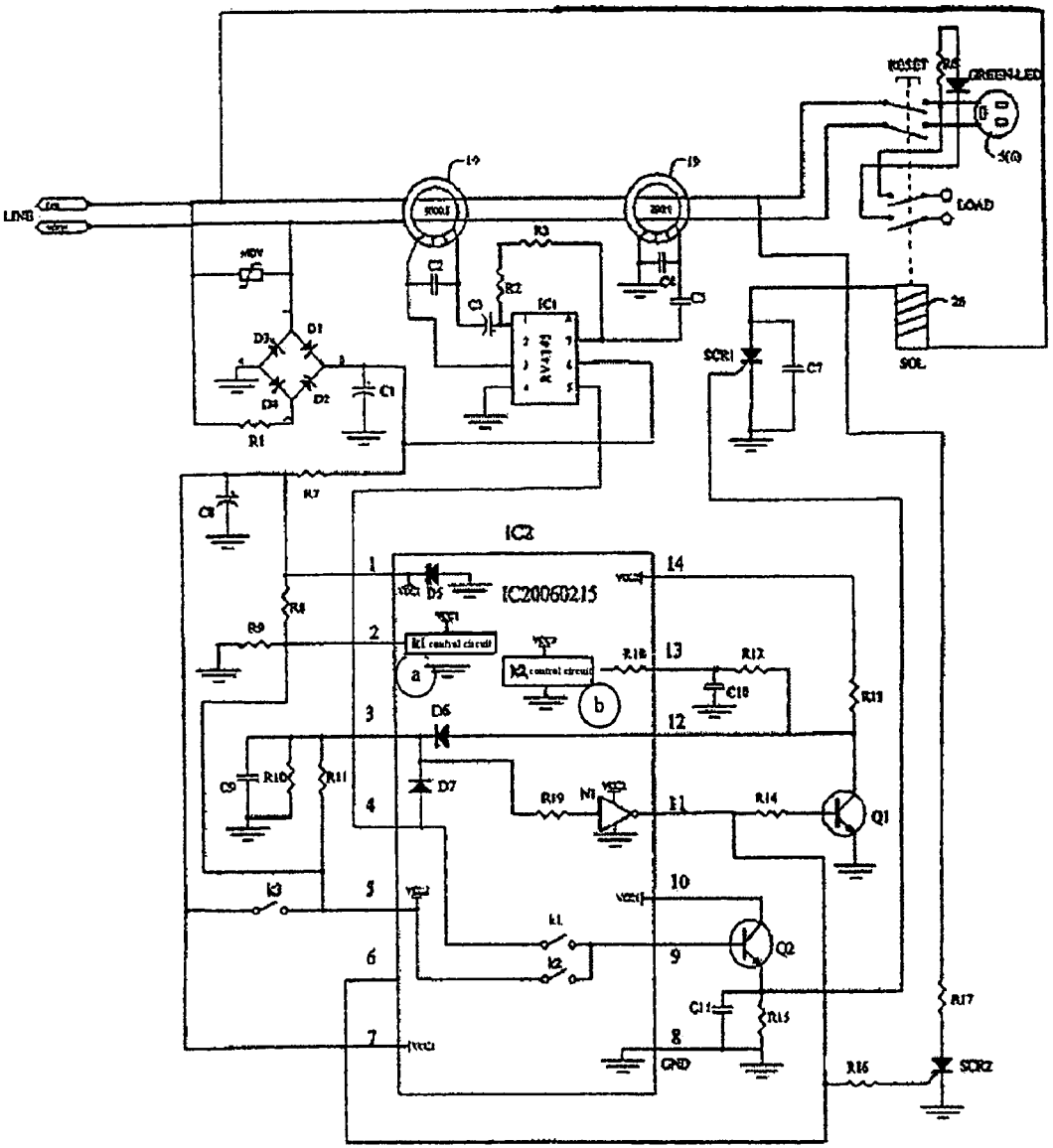
FIG. 6 is a detailed circuit diagram of the control circuit used in the present invention.

There is also a differential transformer 19 used for detecting a ground fault on circuit board 18. As shown in FIG. 6, hot wire HOT and neutral wire WHITE penetrate through differential transformer 19. When a fault or leakage current occurs in the power source circuit, the differential transformer outputs a detection signal to a leakage detecting control chip ("IC1"), such as RV4145. IC1 outputs a control signal such that the trip assembly on circuit board 18 trips the GFCI to interrupt electrical continuity.

Figures 1, 5:
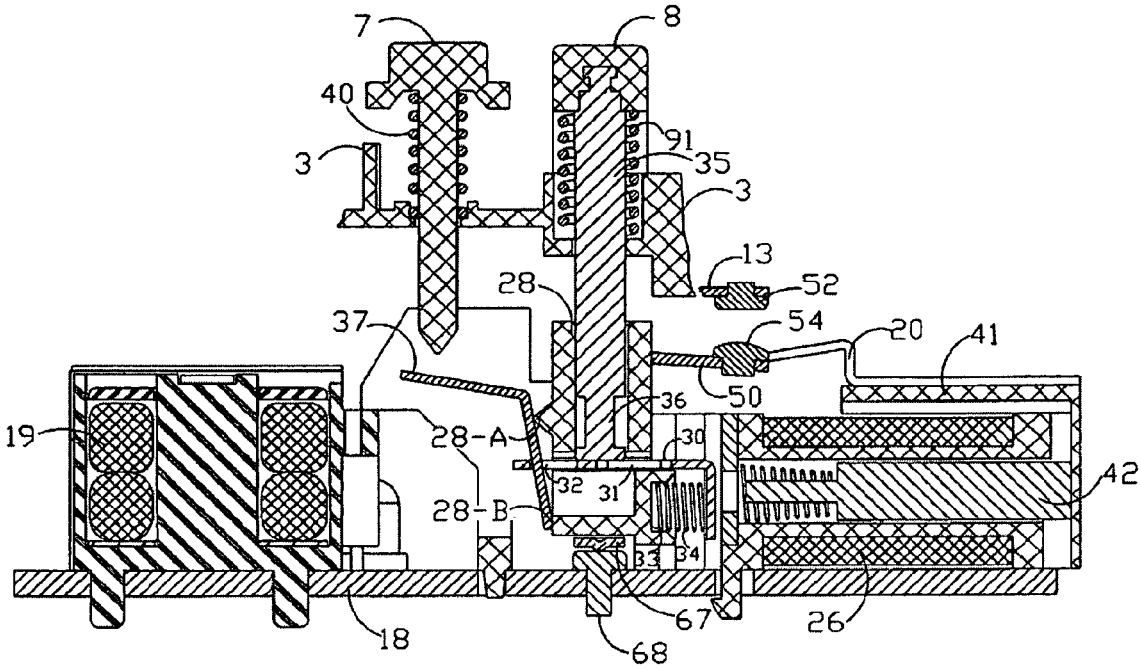
Figures 2, 5:
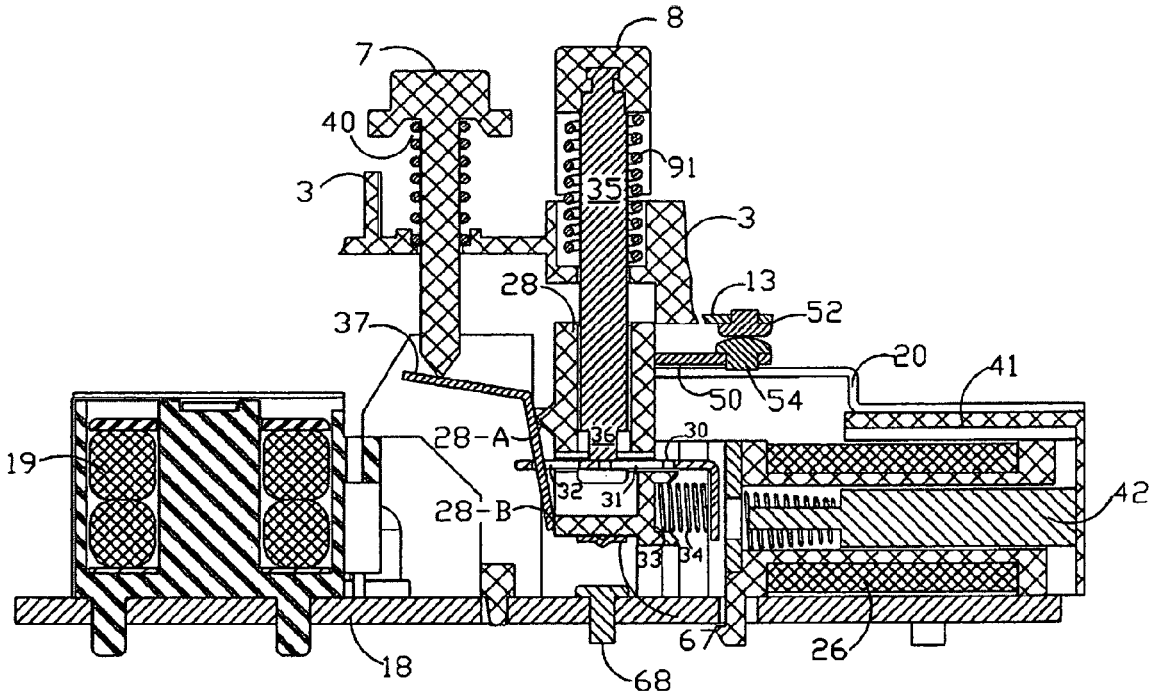
Figures 3, 5:
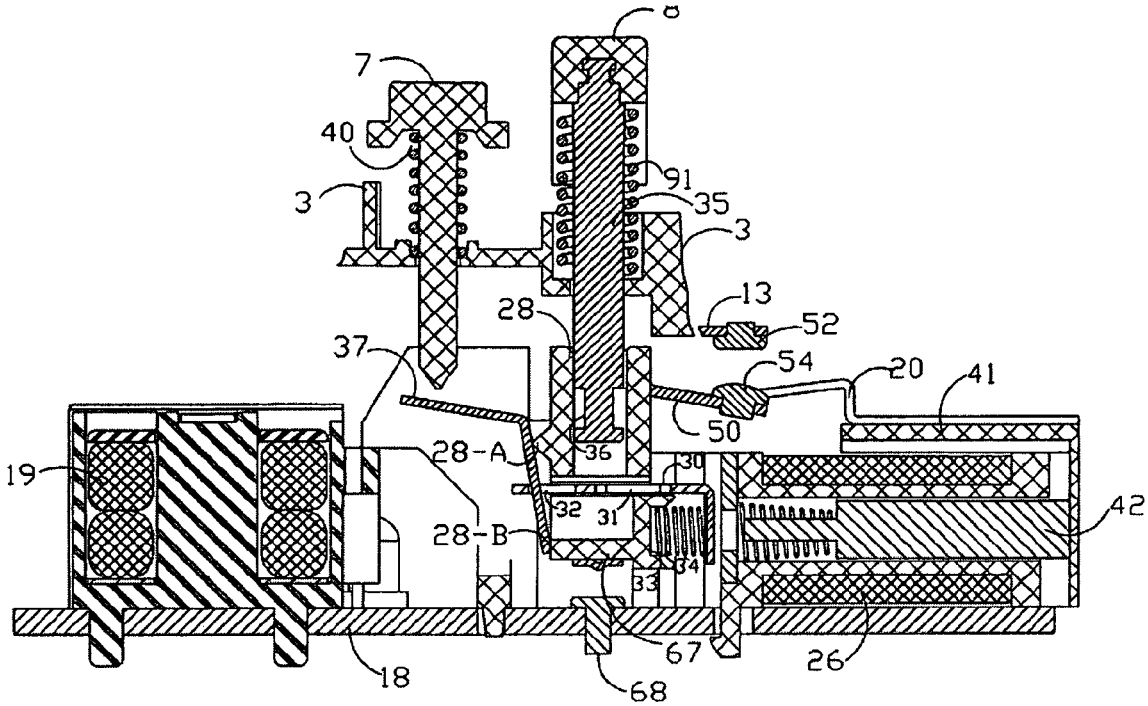
Figures 4, 5:
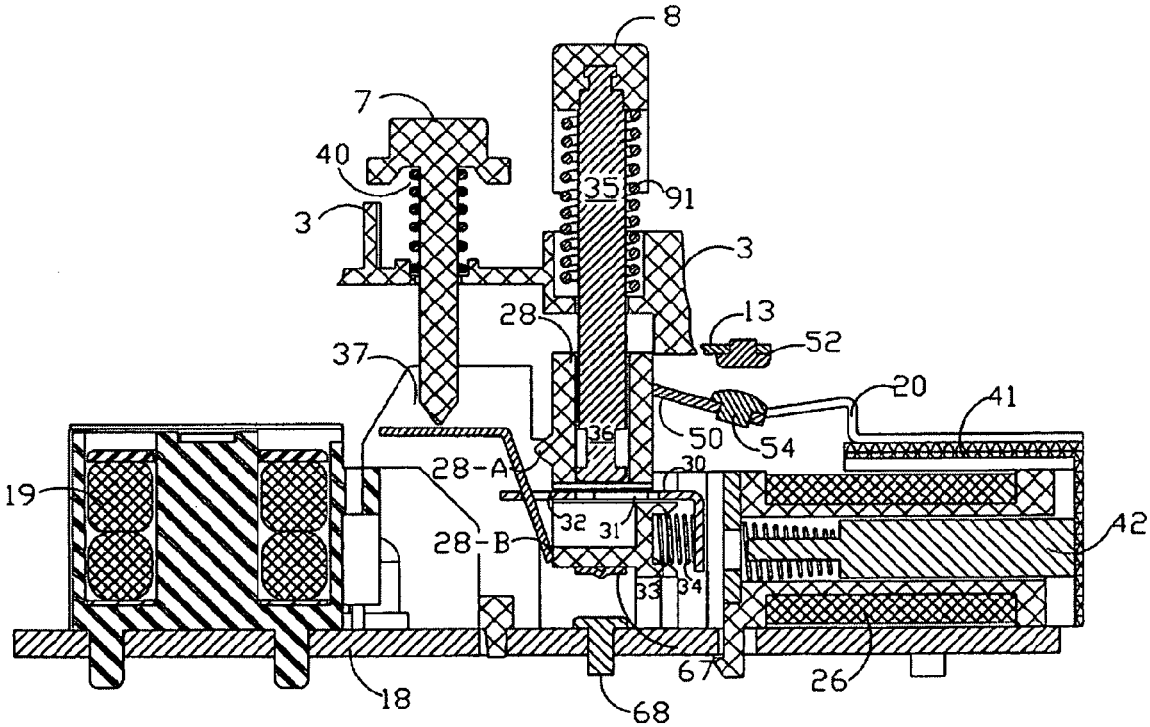

As shown in FIGS. 1, 4, and 5-1, a trip assembly, which can affect power connection/disconnection between flexible power input metal pieces 50, 51 and power output conductors 13, 14 and can supply or interrupt electric power to or from flexible metal pieces 20, 21 through power output conductors 13, 14 to affect power connection/disconnection with respect to power output terminals 80, 81, is also arranged on circuit board 18. This trip assembly includes tripping device 28, locking member 30, locking spring 34, tripping lever 37, and solenoid coil 26.

The tripping device 28 is located below reset button 8 and has a cylindrical shape. Its left and right sides extend outward to form left and right lifting arms. The flexible power input metal pieces 50, 51 and flexible metal pieces 20, 21 are located above the left and right lifting arms and can move up and down along with tripping device 28. Also, as shown in FIG. 4, the movable contact point 54 on flexible power input metal piece 50 and the movable contact point 22 on flexible metal piece 20 cross each other at a position above a side lifting arm of tripping device 28. Similarly, the movable contact point 55 on flexible power input metal piece 51 and the movable contact point 23 on flexible metal piece 21 also cross each other at a position above a side lifting arm of tripping device 28.

A longitudinal central through-hole 29 is formed on the top of tripping device 28. A directional lock 35 underneath the reset button is equipped with reset spring 91 and can move up and down along central hole 29. A circular recessed locking slot 36 is formed in the lower part of reset directional lock 35 and close to its bottom. A movable "L"-shaped locking member 30 formed by a metal material is arranged in the lower part of tripping device 28 and penetrates through tripping device 28. The L-shaped locking member 30 contains a horizontal side and a vertical side. A locking hole 31 is also formed in the horizontal side of locking member 30. A circular slot 33 is formed between the side wall of tripping device 28 and the inner surface of locking member 30. A locking spring 34 is arranged in the circular slot. A solenoid coil 26 with a movable plunger 42 located inside is arranged outside the sidewall of locking member 30. The movable plunger 42 inside solenoid coil 26 faces the outer surface of the vertical side of locking member 30. A protective cover 41 is arranged above the solenoid coil 26. One end of the intermediate support 3 presses against the protective coil 41.

A through-hole 32 is formed at one end on the horizontal side of locking member 30. A "7"-shaped tripping lever 37 penetrates through-hole 32. The top portion of tripping lever 37 is located on the bottom of test button 7. A pivot 28-A is arranged on the sidewall of tripping device 28 close to tripping lever 37. Tripping lever 37 can rotate around the pivot 28-A on the sidewall of tripping device 28.

Tripping device 28, locking member 30, locking spring 34, and tripping lever 37 are connected to each other to form an integral body that can move freely.

As shown in FIGS. 5-1 and 6, power source switch K3 is made of a flexible metal material and is positioned between the bottom surface of tripping device 28 and circuit board 18. There are two contacts 67, 68 on the switch. The power source switch K3 interacts with reset button RESET. When reset button RESET is pressed down, power source switch K3 is closed. When reset button RESET is released, power source switch K3 is open. As shown in FIG. 6, power source switch K3 is connected in series to the end of life detection control integrated circuit IC2 (e.g., model IC20060215). When power source switch K3 is closed, the AC voltage at the power input terminal LINE of the GFCI supplies working power to control chip IC2 after it is rectified by rectifier circuits D1–D4. In the embodiment of the present invention, the power input pin 5 of the end of life detection control chip IC2 (model IC20060215) is connected in series to power source switch K3 and resistor R7 and is then connected to the DC power output from rectifier circuits D1–D4 of the power input terminal LINE of the circuit board.

FIG. 6 is a detailed circuit diagram of the control circuit used in the present invention. As shown in this figure, the leakage current detecting circuit comprises two differential transformers 19, a leakage detection control chip IC1 (e.g., model RV4145), resistors R2, R3, and capacitors C2–C5. When a fault occurs, an unbalanced current between the hot wire HOT and neutral wire WHITE that passes through differential transformers 19 generates a signal. Differential transformers 19 immediately output such an unbalanced signal to a leakage current detection control IC (IC1), which amplifies the signal and sends it out through pin 5 of IC1.

Silicon controlled rectifier (SCR1), solenoid coil SOL with a plunger within it, and capacitor C7 constitute the reset starting/tripping circuit. One end of solenoid coil SOL is connected to the hot wire HOT at the power input terminal LINE. The other end of solenoid coil SOL is connected to the positive electrode of silicon controlled rectifier SCR1. The negative electrode of silicon controlled rectifier SCR1 is grounded. When the control electrode of silicon controlled rectifier SCR1 is at high voltage level, silicon controlled rectifier SCR1 becomes conductive, and a current flows through solenoid coil SOL to generate a magnetic field, which moves the plunger into solenoid coil SOL. The moved plunger hits the sidewall of locking member 30 and pushes the locking member towards the aligned position to be in alignment with tripping device 28. When locking member 30 and tripping device 28 are in alignment, the aperture in the center of tripping device 28 matches locking hole 31 in locking member 30 to allow directional lock 35 of the reset button RESET to move downward. When reset button RESET is reset, electrical continuity is reestablished and there should be power output at the load output terminal LOAD (i.e., power output terminals 109, 110) and the power output socket holes 5, 6 on the face of the front lid of the GFCI. When reset button RESET is tripped, no power is output to the load output terminal LOAD or the power output socket holes 5, 6 on the face of the front lid of the GFCI.

The end of life detection control chip IC2 is an integrated circuit; it comprises first-third diodes (D5, D6, D7), an inverter (N1), two electronic simulation switches (K1, K2), a K1 control circuit that controls open/close of the electronic simulation switch (K1), and a K2 control circuit that controls open/close of the electronic simulation switch (K2). Pin 1 and 2 of IC2 are connected to the positive polarity of the DC voltage output from diode rectifier bridge D1–D4 through a resistor voltage-dividing circuit. Pin 3 of IC2 is grounded through first resistor (R10) and capacitor C10. Pin 4 of IC2 is also connected to pin 5 of the leakage current detection control chip (IC1). Pin 5 of IC2 is connected to pin 1 through power source switch (K3). Second resistor (R11) is connected in parallel between pins 5 and 3. Pins 6 and 11 of IC2 are connected to each other. Pins 7 and 1 of IC2 are connected to each other. Pin 8 of IC2 is a grounding pin. Pin 9 of IC2 is connected to the base of transistor (Q2). The emitter of the transistor (Q2) is grounded through resistor (R15) and capacitor (C11). Pin 10 of IC2 is connected to the collector of the transistor (Q2). Pin 11 of IC2 is connected to the control electrode of silicon controlled rectifier (SCR2) through resistor (R16) and is connected to the base of transistor (Q1) through resistor (R14). The emitter of the transistor (Q1) is grounded. Pin 12 of IC2 is connected to the collector of the transistor (Q1). Pin 13 of IC2 is grounded through capacitor (C10). Pin 13 is connected to pin 12 through resistor (R12). Pin 14 of IC2 is connected to pin 12 through resistor (R13).

In addition, the internal connection relationship is as follows: pin 1 of IC2 is grounded through voltage-stabilizing diode (D5) to provide a power source VCC1 of 5.1 V to IC2. Pin 2 of IC2 is connected to the K1 control circuit. The third diode (D7) is connected between pins 3 and 4 of IC2. Pin 3 is connected to pin 12 through the second diode (D6). Pin 3 is connected to pin 11 through resistor (R19) and inverter (N1). Pin 4 is connected to pin 9 through the electronic simulation switch (K1). Pin 5 is connected to pin 9 through the electronic simulation switch (K2). Pin 13 is connected to the K2 control circuit through resistor (R18). The power source of the K1 control circuit is connected to the power source (VCC1) of IC2. The power source of the K2 control circuit, the power source of the inverter, and pin 14 are all connected to the power source VCC2 of IC2. Pins 10 and 7 of IC2 are connected to the power source VCC1.

IC2 provides an end of life detection circuit, which can generate a simulated current to detect whether the GFCI still has ground fault protection function. The power input pin 5 of IC2 is connected to the DC power output from rectifier circuits D1–D4 at the power input terminal of the GFCI through power source switch K3, which interacts with reset button RESET, and resistor R7.

IC2 used in the present invention can detect whether the service life of the GFCI has ended based on the following principles.

1. When the main power is turned on after the power input terminal LINE of the GFCI is properly connected to the hot wire and neutral wire inside the wall, an AC voltage is applied to the input terminal of the circuit shown in FIG. 6. After the AC voltage is rectified by rectifier circuits D1–D4, a DC voltage is output to leakage current detection control chip IC1. In the meantime, this DC voltage provides a power source voltage VCC1 to pin 1 of IC2 through a voltage-stabilizing circuit provided by R7 and D5, and keeps pin 2 of chip IC2 at a low voltage level through a voltage-dividing circuit provided by R8, R9. The K1 control circuit in IC2 keeps the electronic simulation switch K1 in chip IC2 closed. Since reset button RESET is not depressed, the power source switch K3 that interacts with reset button RESET is open. Power source voltage VCC2 is not generated at pin 5 of IC2. The K2 control circuit in IC2 does not operate, and electronic simulation switch K2 is open. At that time, pins 3, 9, 11 of control chip IC2 are at a low voltage level. Transistors Q2 and Q1 are turned off. Silicon controlled rectifiers SCR1 and SCR2 are in the interrupted state. The reset starting circuit formed by silicon controlled rectifier SCR1 and solenoid coil SOL does not operate. Power is output to the load output terminal LOAD of the GFCI or to the power output socket holes 5, 6 on the face of the front lid of the GFCI. The outlet is stably connected in the power source line.

2. When the user presses down the reset button RESET, since power source switch K3 interacts with reset button RESET, power source switch K3 is closed. After rectification, the AC voltage at the power input terminal of the outlet provides a power source voltage VCC2 equal to VCC1 at pin 1 to pin 5 of control chip IC2 so that the K2 control circuit and inverter N1 in control chip IC2 start to operate. In the meantime, the voltage-dividing circuit formed by resistors R10 and R11 keeps pin 3 of control chip IC2 at a low voltage level. Since pin 3 of control chip IC2 is at a low voltage level, pin 11 of control chip IC2 is at a high voltage level. As a result, silicon controlled rectifier SCR2 becomes conductive to directly ground the hot wire HOT of the power input terminal penetrating through differential transformer 19 via resistor R17 to generate a simulated fault.

At that time, since power source switch K3 is closed, the level at pin 2 of control chip IC2 switches from a low voltage level to a high voltage level to open the electronic simulation switch K1 through the K1 control circuit.

3. At that time, if the ground fault protection function of the GFCI is still in place, differential transformers 19 should detect the aforementioned simulated fault and output a voltage signal to leakage current detection control chip IC1. A high voltage level is output from pin 5 of IC1 to pin 4 of the end of life detection control chip IC2 to set pin 4 of IC2 at a high voltage level and set pin 11 of IC2 at a low voltage level through a positive feedback circuit comprising D6, D7, R19, inverter N1, and transistor Q1. As a result, silicon controlled rectifier SCR2 is turned off, and the simulated fault disappears. Transistor Q1 is turned off. The voltage level at pin 12 of IC2 changes to a high voltage level. After a delay by a delay circuit comprising R12 and C10, the voltage level at pin 13 of IC2 changes to a high voltage level. The K2 control circuit closes electronic simulation switch K2. The voltage level at pin 9 of IC2 changes to high voltage level. Silicon controlled rectifier SCR1 in the reset starting/tripping circuit becomes conductive. A current flows through solenoid coil SOL to generate a magnetic field. The plunger in the coil pushes tripping device 28 and locking member 30 of the GFCI to move so that reset button RESET can be reset.

After reset button RESET is reset, the user releases the reset button. The power source switch K3 is open, and the voltage level at pin 2 of IC2 changes to a low voltage level. Electronic simulation switch K1 is closed. The VCC2 at pin 5 of chip IC2 changes to a low voltage level. The K2 control circuit does not operate, and K2 is opened automatically. Since the aforementioned simulated fault has disappeared, the voltage level at pin 4 of IC2 also changes to a low voltage level. The voltage level at pin 9 of IC2 changes to low voltage level. Silicon controlled rectifier SCR1 is turned off. The magnetic field in coil SOL disappears. As shown in FIG. 5-2, recessed locking slot 36 formed on directional lock 35 at the bottom of reset button RESET fits in the locking hole 31 of locking member 30 to release reset button RESET, which drives tripping device 28 to move up to elevate the flexible metal pieces 50, 51, 20, 21 located above the lifting arms on the two sides of tripping device 28. As a result, the movable contact points 54, 55 on flexible power input metal pieces 50, 51 contact the fixed contact points 52, 53 on power output conductors 13, 14 to electrify power output conductors 13, 14. Power is output to the power output socket holes 5, 6 on the face of the GFCI. Also, the movable contact points 22, 23 on flexible metal pieces 20, 21 contact the fixed contact points 15, 16 on power output conductors 13, 14 to electrify the flexible metal pieces 20, 21 having contact with power output terminals 80, 81. Power is output to power output terminals 80, 81 of the GFCI and to the power output socket holes 5, 6 on the face of the outlet. The GFCI can operate normally.

If the service life of the GFCI has ended so that the GFCI cannot provide ground fault protection, a high voltage level is not output from pin 5 of the leakage current detection control chip IC1. Pin 4 of the end of life detection control chip IC2 is kept at low voltage level. When reset button RESET is depressed to close power source switch K3, the voltage level at pin 3 of IC2 becomes a low voltage level, while pin 11 of IC2 is kept at a high voltage level. Q1 is turned on. Pins 12 and 13 of IC2 are kept at a low voltage level, and electronic simulation switch K2 is kept open. Pin 9 of IC2 is kept at a low voltage level. Transistor Q2 is turned off. The silicon controlled rectifier SCR1 in the reset starting/tripping circuit is kept off. No current flows through solenoid coil SOL, and a magnetic field is not generated. Tripping device 28 and locking member 30 of the GFCI do not move. Reset button RESET cannot be reset. No power is output to the load output terminal LOAD of the GFCI or to the power output socket holes 5, 6 on the face of the outlet. This informs the user that it is necessary to replace the GFCI.

According to the present invention, with the aid of the end of life detection control chip IC2 and leakage current detection control chip IC1 on the circuit board, the user can check whether a GFCI still has its ground fault protection function and whether the service life of the GFCI has ended by pressing the reset button RESET. If the service life of the GFCI has ended, the end of life detection control chip IC2 does not output a control signal so that the silicon controlled rectifier SCR1 in the reset starting/tripping circuit is kept off. As a result, no current flows through the solenoid coil SOL, and a magnetic field is not generated. The tripping device 28 and locking member 30 in the GFCI do not operate so that the resetting of reset button RESET is prevented. Therefore, no power is output to the load output terminal LOAD of the GFCI or to the power output socket holes 5, 6 on the face of the outlet. This alerts the user that it is necessary to replace the GFCI.

As shown in FIG. 6, the diode D6 in the end of life detection control chip IC2 has a positive feedback effect. When a low voltage level is output from pin 11 of end of life detection control chip IC2, the trigger signal of silicon controlled rectifier SCR2 disappears. When transistor Q1 is turned off, the high voltage level signal at the collector of transistor Q1 is fed back to the input terminal of inverter N1 to keep pin 11 of the end of life detection control chip IC2 at a low voltage level and the pins 12, 13 at a high voltage level to ensure that electronic simulation switch K2 is constantly closed. Diode D7 is used so that when the collector of transistor Q1 is at a high voltage level, this high voltage level signal is not transferred to the leakage current detection control chip IC1. Diode D5 is a voltage-stabilizing diode, which provides a power source of 5.1 V to the entire control circuit.

In order to ensure that the aforementioned protective circuit can detect the end of the service life reliably, pin 3 of the end of life detection control chip IC2 is also grounded through a capacitor C9. Capacitor C9 is used to guarantee that pin 9 of the end of life detection control chip IC2 is grounded through transistor Q2, resistor R15, and capacitor C11 when pin 3 of control chip IC2 reaches a low voltage level at the time K3 is closed. Resistor R15 is used to prevent mis-conduction of silicon controlled rectifier SCR1 caused by a critical voltage rise rate (dv/dt). Capacitor C11 is used as a filter capacitor to eliminate interference signals to prevent mis-conduction of SCR1. Transistor Q2 is used to drive SCR1. R12 and C10 are used for delay. Resistors R8, R9 are used to guarantee that pin 2 of the end of life detection control chip IC2 is at a low voltage level when the power is turned on.

When the GFCI works normally and is able to provide ground fault protection, as shown in FIGS. 5–2, and 6, reset button 8 (RESET) is depressed to drive directional lock 35 to move down so that power source switch K3 (contacts 67, 68) interacting with reset button 8 is closed. The electronic simulation switch K2 in IC2 is closed. Pin 9 of chip IC2 is at a high voltage level. Transistor Q2 is turned on, and the control electrode of silicon controlled rectifier SCR1 becomes conductive. A current flows through solenoid coil 26 (SOL) and a magnetic field is generated, which pulls in plunger 42 to hit the sidewall of locking member 30 to make locking member 30 move into the alignment position with tripping device 28. The bottom part of directional lock 35 penetrates through the locking hole 31 of locking member 30. Because of the inertia of the power source switch K3, the two ends 67, 68 are disconnected so as to open the power source switch K3. Pin 9 of the end of life detection control chip IC2 switches to a low voltage level. Transistor Q2 is turned off. No voltage is present at the control electrode of silicon controlled rectifier SCR1. Silicon controlled rectifier SCR1 is turned off. No current flows through solenoid coil 26, and the magnetic field disappears. The locking spring 34 between locking member 30 and tripping device 28 pulls back locking member 30. As a result, the locking hole 31 of locking member 30 slides into guiding slot 36. Also, because of the release of the spring 91 at the top of directional lock 35, tripping device 28 is driven to move up to elevate the flexible metal pieces 50, 51, 20, 21 located above the lifting arms on the two sides of tripping device 28. As a result, the movable contact points 54, 55 on flexible power input metal pieces 50, 51 contact the fixed contact points 52, 53 on power output conductors 13, 14 to electrify power output conductors 13, 14. Power is output to power output socket holes 5, 6 on the face of the GFCI. Also, the movable contact points 22, 23 on flexible metal pieces 20, 21 contact the fixed contact points 15, 16 on power output conductors 13, 14 to electrify the flexible metal pieces 20, 21 in contact with power output terminals 80, 81. In this way, power connection is established from the power input terminal of the GFCI to the power output sockets and then to the load terminal. In other words, power is output to the power output terminals 80, 81 of the GFCI and to the power output socket holes 5, 6 on the face of the outlet.

As shown in FIGS. 5-3, and 6, if ground fault occurs during use, after detecting the leakage current, differential transformer 19 will output a voltage signal to leakage current detection control chip IC1. A high voltage level is output from pin 5 of IC1. Pin 4 of the end of life detection control chip IC2 becomes high voltage level. Since the switch K1 in control chip IC2 is closed, pin 9 of chip IC2 is at high level. Transistor Q2 is turned on. The control electrode of silicon controlled rectifier SCR1 becomes conductive. A current flows through solenoid coil 26 (SOL) to generate a magnetic field, which pulls in plunger 42 to hit locking member 30 to make it move, as shown in FIG. 5-3. The bottom part of directional lock 35 penetrates through locking hole 31 of locking member 30. Reset button 8 is tripped, and tripping device 28 falls. The flexible power input metal pieces 50, 51, 20, 21 located above the two lifting arms of tripping device 28 drop as well to disconnect the movable contacts 54, 55 on flexible power input metal pieces 50, 51 from the fixed contacts 52, 53 on power output conductors 13, 14. The fixed contacts 15, 16 on power output conductors 13, 14 are disconnected from the movable contacts 22, 23 on flexible metal pieces 20, 21 so that neither power output conductors 13, 14 nor flexible metal pieces 20, 21 are electrified. Therefore, no power is output to the power output terminals 80, 81 of the GFCI or to the power output socket holes 5,6 on the surface of the outlet. The entire power output of the GFCI is interrupted.

As shown in FIG. 5-4, according to the present invention, the test button 7 (TEST) has a tail end which penetrates through intermediate support 3, which touches upon the end of tripping lever 37. This tail end has a slipped over spring 40. If the user wants to detect whether the mechanical operation of the GFCI is operational and reliable, he/she can depress test button 7. The tail end of test button 7 pushes the end of tripping lever 37 to move downwards to pull locking member 30. Locking spring 34 on the other side of the locking member is compressed. The locking slot 36 on directional lock 35 jumps out of locking hole 31 on locking member 30. Tripping device 28 falls, and flexible power input metal pieces 50, 51 fall as well. The movable contacts on the flexible power input metal pieces are disconnected from the fixed contacts on power output conductors 13, 14. As a result, power output conductors 13, 14 are not electrified. The flexible metal pieces 20, 21 connected to power output terminals 80, 81 are not electrified, either. Since neither power output conductors 13, 14 nor power output terminals 80, 81 are electrified, no power is output to the load terminals, that is, power output terminals 80, 81 of the GFCI or to the power output sockets 5, 6 on the surface of the outlet.

The user can also forcibly interrupt the power output of the GFCI by pressing test button 7. As shown in FIG. 5-4, the process is as follows. When test button 7 is depressed, the tail end presses against the top portion of tripping lever 37 to make tripping lever 37 rotate around pivot 28-B. The sidewall of tripping lever 37 moves away from the pivot 28-A on the sidewall of tripping device 28. Since tripping device lever 37 penetrates through tripping lever hole 32 on locking member 30, it causes locking member 30 to move. As a result, the lock slot 36 on directional lock 35 slips out of locking hole 31. Tripping device 28 drops, and flexible power input metal pieces 50, 51 fall as well. The movable contacts on the flexible power input metal pieces are disconnected from the fixed contacts on power output conductors 13, 14. As a result, the flexible metal pieces 20, 21 connected to power output terminals 80, 81 are not electrified, either. Since neither power output conductors 13, 14, nor power output terminals 80, 81 are electrified, the outlet outputs no power.

As shown in FIG. 4, two pairs of position limiting pieces 43, 44 and 73, 74 are arranged on the coil frame of solenoid coil 26 below the movable contacts of flexible power input metal pieces 50, 51 and below flexible metal pieces 20, 21. These position limiting pieces are designed to ensure that the flexible metal pieces and their respective movable contact points are secured and that solenoid coil 26 is not damaged due to the fall of the flexible metal pieces.

As described above, the GFCI of the present invention not only provides ground fault protection but also has the capability to detect whether the service life of the GFCI has ended after the device is properly connected to the hot and neutral wires of a power source inside a wall and after the reset button is depressed to close power source switch K3. If the GFCI operates properly and still has the ground fault protection function, the GFCI can be reset, and can output power. If the service life of the GFCI has ended, the end of life detection control chip IC2 prohibits the reset of the reset button. No power is output to the power output sockets or load output terminals of the GFCI. This can alert the user to replace the GFCI. In addition, when certain parts of the GFCI become defective, such as when the solenoid coil does not work properly, the present invention provides a forcible mechanical interruption of the power output of the device outlet by utilizing the test button, which can guarantee the safety of the user and the safety of electrical appliances.

Finally, the GFCI of the present invention provides reverse wiring protection. When the output wires and input wires are reversely installed, the depression of the reset button cannot activate the power source switch K3 so as to activate the end of life detection control chip IC2 to produce a simulated fault. As a result, the device cannot be reset.

While the invention has been described by way of examples and in terms of the preferred embodiments, it is to be understood that the invention is not limited to the disclosed embodiments. On the contrary, it is intended to cover various modifications as would be apparent to those skilled in the art. Therefore, the scope of the appended claims should be accorded the broadest interpretation so as to encompass all such modifications.

We claim:

1. A circuit interrupting device containing a line side connection capable of being electrically connected to a source of electricity; a load side connection capable of being electrically connected to a load side conductor; and a user accessible load; wherein said circuit interrupting device comprises:

a housing;

a trip assembly positioned in a base of said housing;

a circuit board positioned in said base of said housing; said circuit board comprising a first pair of flexible metal pieces having a first end and a second end; wherein said first pair of flexible metal pieces is operationally connected to power source input terminals; said first end of each of said first pair of flexible metal pieces passing through a differential transformer to be operationally connected to a hot input line or a neutral input line; said second end of each of said second pair of flexible metal pieces having a movable contact point;

a second pair of flexible metal pieces having a first end and a second end; wherein said first end of each of said first pair of flexible metal pieces is operationally connected to a hot power output terminal or a neutral power output terminal; each of said second pair of flexible metal pieces having a movable contact point;

a pair of output conductors positioned in a central portion of said housing; wherein each of said output conductors contains a pair of fixed contact points;

wherein said movable contact point of each of said first pair of flexible metal pieces and said movable contact point of each of second pair of flexible metal pieces are capable of connecting/disconnecting to each of said fixed contact points of said pair of output conductors.

2. The circuit interrupting device according to claim 1, wherein said trip assembly comprises a tripping device, a locking member, a locking spring, a tripping lever, and a solenoid coil.

3. The circuit interrupting device according to claim 2, wherein said tripping device is positioned underneath a reset button; said tripping device having a central aperture to receive a directional lock which is coupled to said reset button; said directional lock having a blunt end; said directional lock being movable in a vertical direction in said aperture;

wherein said locking member is L-shaped, containing a horizontal side extending into said tripping device and through the aperture and a vertical side having an inner surface and an outer surface; said horizontal side of said locking member having an opening therein and being movable through said aperture in a horizontal direction between an aligned position in which the opening of said locking member is aligned with said blunt end of said directional lock and a misaligned position in which the opening is misaligned with said blunt end of said directional lock;

said locking spring being located between a side wall of said tripping device and said inner surface of said vertical side of said L-shaped locking member;

said solenoid coil being positioned at said outer surface of said L-shaped locking member; said solenoid coil having a movable plunger; whereby when said solenoid coil is energized, said plunger moves towards said outer surface of said vertical side of said locking member, thereby moving said locking member into said aligned position; and said tripping lever being connected to a hole at said horizontal side of said L-shaped locking member.

4. The circuit interrupting device according to claim 2, wherein said tripping device comprises a pair of lifting arms positioned below each of said movable contacts points.

5. The circuit interrupting device according to claim 4, wherein each of said movable contact points of said first pair of said flexible metal pieces is in a different cross sectional plane from said each of said movable contact points of said second pair of said flexible metal pieces.

6. The circuit interrupting device according to claim 1, wherein a bottom of said tripping device is operationally connected to said circuit board through a power source switch containing a movable contact located at said bottom of said tripping device and a fixed contact located at said circuit board; whereby when said reset button is depressed, said movable contact is in contact with said fixed contact so as to close said power source switch and when said reset button is released, said movable contact is detached from said fixed contact so as to open said power source switch.

7. The circuit interrupting device according to claim 6, further comprising an end of life detection control integrated circuit (IC); wherein said end of life detection control IC starts to operate when said power source switch is closed.

8. The circuit interrupting device according to claim 7, wherein said end of life detection circuit generates a simulated fault to detect said circuit interrupting device; whereby when said circuit interrupting device functions properly, the depression and release of said reset button reestablish said electrical continuity and when said circuit interrupting device fails to detect said simulated fault, the depression and release of said reset button prevent said electrical continuity.

9. The circuit interrupting device according to claim 7, wherein said end of life detection control IC is an IC20060215.

10. The circuit interrupting device according to claim 7, wherein said end of life detection control IC is connected to a leakage current detection control integrated circuit (IC).

11. The circuit interrupting device according to claim 10, wherein said leakage current detection control IC is an RV4145.

12. The circuit interrupting device according to claim 10, wherein said leakage current detection control IC is connected to the differential transformer; whereby when a fault is detected, the differential transformer sends a signal to said leakage current detection control IC, which in turn sends a signal to a silicon control rectifier (SCR) to trigger said trip assembly to interrupt said electrical continuity.

13. The circuit interrupting device according to claim 7, further comprising an indicator light; said indicator light is connected to said output terminals; whereby when said device is not functional when said reset button is depressed, said indicator light is lighted.

14. The circuit interrupting device according to claim 1, wherein each of said pair of said output conductor comprises a pair of gripping wing pieces protruded to output socket holes at a front lid of said housing.

15. The circuit interrupting device according to claim 2, wherein said device has a test button at a front lid of said housing; wherein said test button has a tail end which is extended to an end of said tripping lever; wherein when said test button is depressed, said tail end of said test button presses against said tripping lever, which causes said device to mechanically trip.

16. The circuit interrupting device according to claim 1, further comprising a position limiting piece below each of said first and said second pair of flexible metal pieces.

17. The circuit interrupting device according to claim 7, wherein said circuit interrupting device has reverse wire protection.

18. A method for detecting an end of life of a circuit interrupting device comprising:

depressing said reset button of said circuit interrupting device according to claim 7;

releasing said reset button; and observing whether said circuit interrupting device has been reset.

19. A method for detecting an end of life of a circuit interrupting device comprising:

depressing said reset button of said circuit interrupting device according to claim 7;

releasing said reset button; and monitoring said indicator light.

* * * * *

UNITED STATES PATENT AND TRADEMARK OFFICE

CERTIFICATE OF CORRECTION

PATENT NO. : 7,195,500 B2
APPLICATION NO. : 11/362037
DATED : March 27, 2007
INVENTOR(S) : Huadao Huang It is certified that error appears in the above-identified patent and that said Letters Patent is hereby corrected as shown below:

Replace the sentence beginning at column 13, line 42, and ending at column 13, line 44, of claim 1, which recites as follows:

"said second end of each of said second pair of flexible metal pieces having a movable contact point"

with the following:

--said second end of said first pair of flexible metal pieces having a movable contact point-- and,

Replace the sentence beginning at column 13, line 46, and ending at column 13, line 49, of claim 1, which recites as follows:

"wherein said first end of each of said first pair of flexible metal pieces is operationally connected to a hot power output terminal or a neutral power output terminal"

with the following:

UNITED STATES PATENT AND TRADEMARK OFFICE

CERTIFICATE OF CORRECTION

PATENT NO. : 7,195,500 B2
APPLICATION NO. : 11/362037
DATED : March 27, 2007
INVENTOR(S) : Huadao Huang It is certified that error appears in the above-identified patent and that said Letters Patent is hereby corrected as shown below:

--wherein said first end of each of said second pair of flexible metal pieces is operationally connected to a hot power output terminal or a neutral power output terminal;--

Signed and Sealed this

Eighth Day of January, 2008

JON W. DUDAS
*Director of the United States Patent and Trademark Office*